United States Patent [19]

Darnell, II et al.

[11] Patent Number: 4,460,097

[45] Date of Patent: Jul. 17, 1984

[54] ADJUSTABLE STORE FIXTURE SYSTEM

[75] Inventors: James P. Darnell, II, Overland Park, Kans.; Jon D. Bridgwater, Cedar City, Utah

[73] Assignee: Hallmark Cards Incorporated, Kansas City, Mo.

[21] Appl. No.: 224,942

[22] Filed: Jan. 14, 1981

[51] Int. Cl.[3] ..... A47B 47/00

[52] U.S. Cl. ..... 211/189; 108/108; 211/128

[58] Field of Search ..... 211/189, 153, 128, 55, 211/192, 190, 193; 312/117, 118; 108/92, 93, 101, 107, 108, 111

[56] References Cited

U.S. PATENT DOCUMENTS

| | | | |
|---|---|---|---|
| 1,622,107 | 3/1927 | Harrod | 108/92 X |
| 2,034,115 | 3/1936 | Palen | 211/55 |
| 2,356,688 | 8/1944 | O'Reilly | 211/128 X |
| 2,956,688 | 10/1960 | Galassi | 108/108 |
| 3,601,432 | 8/1971 | Fenwick | 211/190 X |
| 3,667,826 | 6/1972 | Wood et al. | 211/128 X |
| 3,777,897 | 12/1973 | Gray | 211/128 X |
| 3,892,450 | 7/1975 | Kolster | 312/117 |
| 4,116,509 | 9/1978 | Smith | 108/108 X |

*Primary Examiner*—William E. Lyddane
*Assistant Examiner*—Peter A. Aschenbrenner
*Attorney, Agent, or Firm*—Schmidt, Johnson, Hovey & Williams

[57] ABSTRACT

A prefabricated, readily adjustable easily assemblable product display fixture having components which can be installed and interchanged without the use of special tools and substantially without nut-and-bolt type fasteners. As a result of the abundant flexibility provided through the readily interchangeable components employing a substantially common type interlocking system, the fixture may be adapted for display of such diverse product items as greeting cards in a stair-stepped array on a special inclined deck structure. The fixture includes a base a pair of extensible upright standards interlockingly secured to the base at the rear of the latter and, in one form, a simplified card display deck suspended from the standards by sling brackets which support the deck in overhanging relationship to the base therebelow and which permit the deck to angle upwardly and rearwardly from the point of suspension in rearwardly leaning mode to bear against upper portions of the standards. Ready height positioning of the standards is available through the medium of quick-release latch means associated with the telescopic sections of each standard. A structural, transversely extending tie member may span the standards above the base in a manner to rigidify the standards.

9 Claims, 19 Drawing Figures

11.
11.

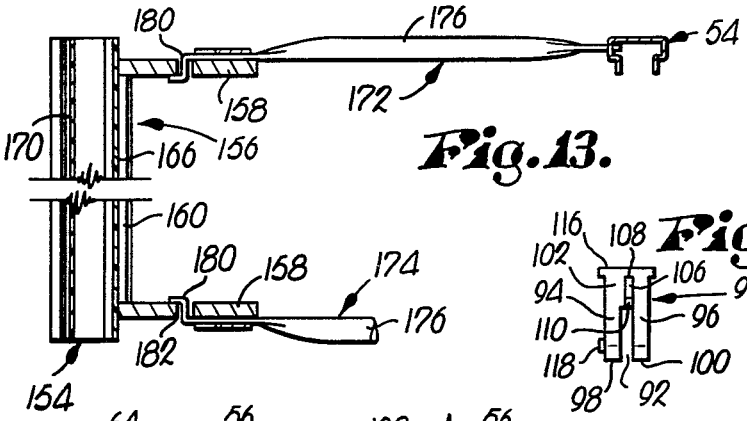
Fig.13.
Fig.17.
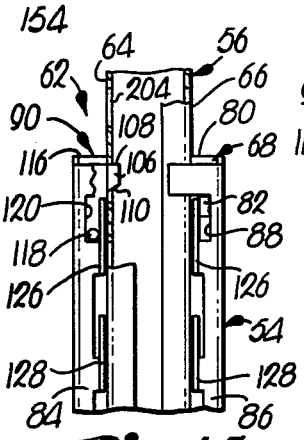
Fig.15.
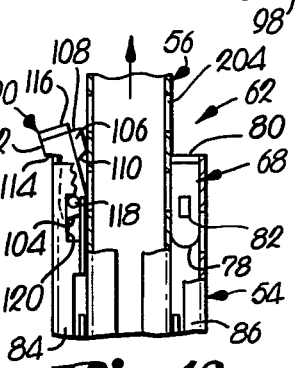
Fig.16.
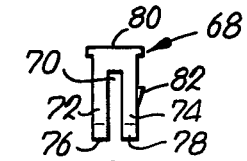
Fig.18.
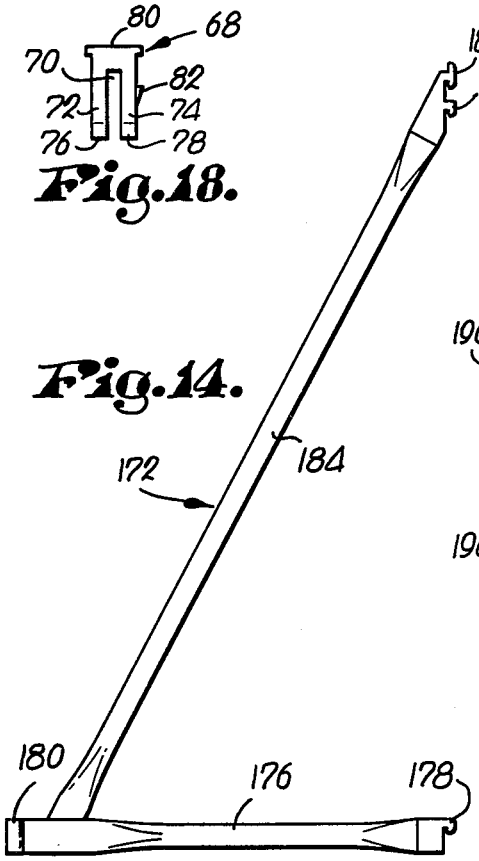
Fig.14.
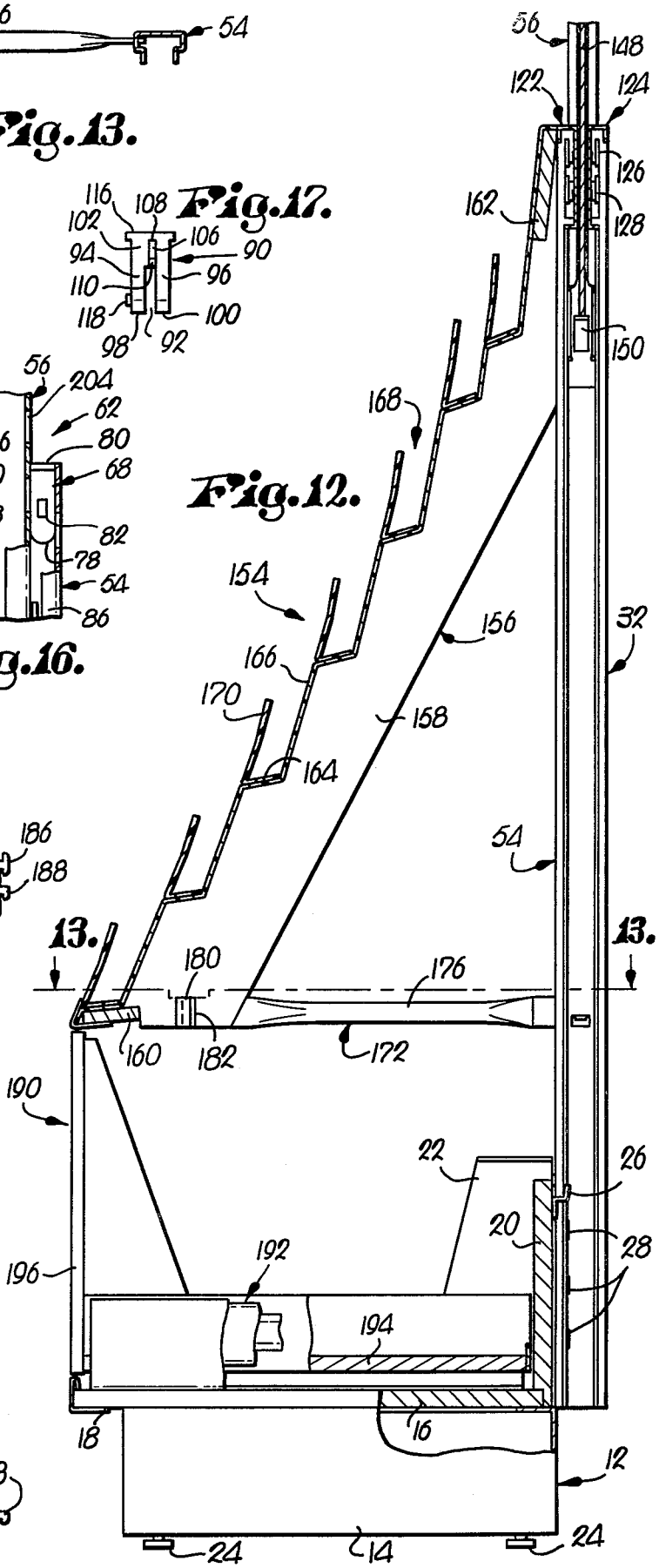
Fig.12.

ADJUSTABLE STORE FIXTURE SYSTEM

TECHNICAL FIELD

This invention relates generally to the field of product display systems and fixtures and, more particularly, to a fixture of the aforementioned type which is readily assemblable and disassemblable without special tools, by relatively unskilled labor, and which may be converted into a wide assortment of different final configurations to accommodate a variety of display environments and product types.

BACKGROUND OF THE PRESENT INVENTION

Display fixtures for greeting cards, wrapping paper, paper party products and other such items have long been available and have in many instances possessed the inherent abilities to be rather quickly assembled and disassembled, modified and converted as might be necessary or desirable. On the other hand, not all of such previously available prefabricated fixtures have possessed the degree of flexibility desired insofar as being readily convertible between greeting card display and the display of other merchandisable items is concerned, or sufficiently inherently flexible to accommodate the merchandising of several different kinds of products within the same fixture. Furthermore, not all have provided this degree of flexibility in connection with special space and compatibility considerations existing at particular installations frequently existing in grocery store and similar retail outlets wherein a line of fixtures will serve to define limits of an aisle along which customers may pass to examine the displayed articles. In those environments, it is especially beneficial for the fixtures to be not only compatible with their adjacent units, but also capable of being readily assembled, disassembled and converted without substantially disturbing other existing fixtures defining the aisle. In such situations, work on the fixture in question is desirably conducted from the aisle itself, and oftentimes serious space constraints are present.

Furthermore, in aisle-type installations of the fixtures, it is not infrequent that they are subjected to considerable abuse by floor scrubbing equipment and the like, either during or after business hours; it is therefore essential that the fixtures exhibit an unusual degree of structural integrity and balance in order to avoid damage to the fixtures themselves and the risk of personal injury to personnel and customers form tipover.

Typically, the persons actually installing the fixtures are not highly mechanically skilled, nor are they possessed of an abundance of time in which to accomplish the appointed task. Consequently, ease of setup and conversion to suit the particular display function at hand without sacrificing structural integrity, safety and aesthetic appeal are extremely important considerations. In this same connection, such efforts in respect to initial setup and subsequent modification of the component parts of the fixture need to be capable of being carried out with a minimum use of pliers, wrenches, and screwdrivers and without specially designed tools and, similarly, with a minimum use of nuts, bolts and/or screws. Simple hand installation and assembly by a limited number of people, and preferably by only one person, is desired in those merchandising situations typically encountered in grocery stores, pharmacies and variety stores.

SUMMARY OF THE PRESENT INVENTION

Accordingly, an important object of the present invention is to provide a product display fixture of the prefabricated type which is not only readily assemblable and disassemblable by a minimum number of persons without special tools or skills within limited space constraints, but which is also unusually flexible insofar as the particular arrangement of component parts is concerned for the handling and display of a significant variety of products according to the particular merchandising demands at hand so that changes can be made not only in the types of products displayed, but also in the displayed heights of the products, the use of lighting, pegboards and panel boards, while all the while avoiding any sacrifice of structural integrity and aesthetic appeal.

Pursuant to the foregoing, the fixture in accordance with the present invention utilizes a special, integral gondola base serving as the cornerstone for all variations of the fixture which might ultimately be desired, except for those having special dimensional requirements. The base is designed to detachably accept a pair of extensible upright standards at its rear side and to support the same in a cantilevered manner as a variety of interchangeable hooks, shelves, card display decks and the like are suspended forwardly from the standards in overhanging relationship to the base itself. Hooks at the rear side of the base slip into mating slots in the standards, and a spring-loaded locking tab at that location is readily manually manipulable to sturdily lock the standards to the base adjacent their lower ends.

In order to provide height adjustment of the fixture, each of the standards comprises a pair of relatively telescoping sections provided with special latching means at the point of emergence of the inner section from the outer section. Such latching means is designed to release quickly upon attempted extension of the inner section for lengthening the standard yet to readily relatch under finger pressure when the selected height has been achieved.

One of the product displaying structures which may be selected for support by the standards is a greeting card holding-and-displaying deck having stairstepped echelons of card-receiving compartments sloping generally upwardly and rearwardly away from the prospective purchaser. The deck is of simple open-box frame construction provided with an overlay sheet of corrugated, vacuumed formed, synthetic resin material in turn providable with transverse partitions and card-retaining, transparent shields, and the deck itself is suspended in place by a pair of sling-like brackets at opposite lower, front extremities of the deck in such a way that the upper rear extremity of the deck leans back against and is supported by upper portions of the standards.

In order to rigidify the upper regions of the standards, one or more transverse tie members is provided which may be inserted between the two standards from the aisle and without spreading the same apart. Specially configured, interconnecting openings at opposite ends of each tie member in a back panel and inturned flanges thereof cooperate with laterally extending hooks of the standards to permit such frontdisposed, from-the-aisle loading of the tie member without sacrificing the rigidity provided thereby.

Other significant features include the way in which the sling-supported card deck totally avoids the need for support through underlying drawer structure or the like and permits the drawer to be essentially opensided with the exception of a floor and front decorative panel; the way in which certain components of the fixture may be shared in common by back-to-back fixtures in an aisle display; the way in which pegboard or decorative panel board material is supported and readily adjustable with the standards for height selection; and the simplified yet structurally sound configuration of a transverse display bar which may be spanned between the uprights and utilized to carry cantilever-supported bow hangers and the like.

BRIEF DESCRIPTION OF THE DRAWINGS

FIG. 1 is a left front perspective view of a fixture constructed in accordance with the principles of the present invention, a decorative end panel of the fixture being removed to reveal details of construction, and the fixture being assembled with components particularly conducive to the merchandising of greeting cards and the like;

FIG. 12 is a left end view of the fixture partially in section and partially in elevation with a greeting card display deck suspended from the standards in lieu of other alternative product-supporting-and-displaying structures;

FIG. 13 is a fragmentary, transverse, cross-sectional view thereof taken substantially along line 13—13 of FIG. 12;

FIG. 14 is a side elevational view of one of the sling brackets used to suspend the card deck of FIG. 12 from the upright standards;

FIG. 15 is an enlarged, fragmentary elevational view of one of the upright standards illustrating the special latching means which retains the inner telescopic section of the standard against retraction yet provides quick release thereof upon attempted extension;

FIG. 16 is an elevational view similar to FIG. 15 illustrating the way in which the latch is released upon extension of the inner section;

FIG. 17 is an elevational view of one side of the latching pawl of the latch means illustrated in FIGS. 15 and 16;

FIG. 18 is a similar elevational view of a spacer component used in connection with the latching pawl of FIG. 17 on the opposite side of the telescoping inner section of the standard.

DETAILED DESCRIPTION

Figure 2:
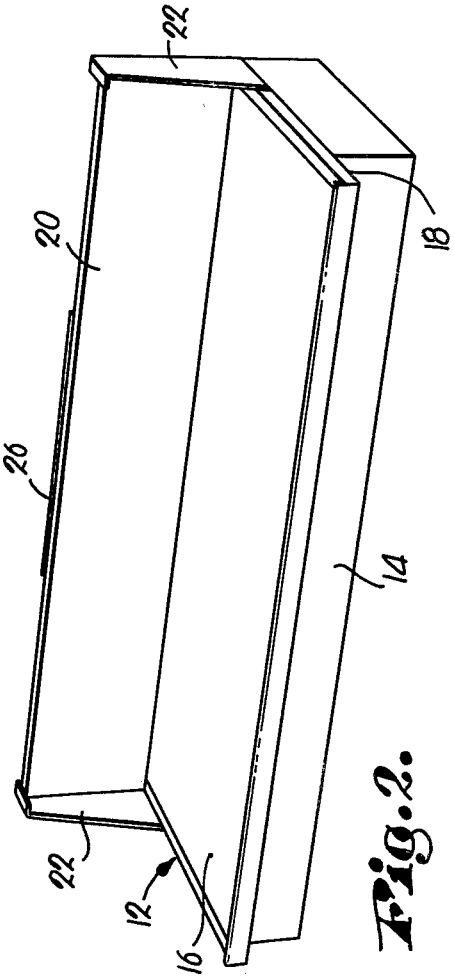
FIG. 2 is an enlarged, right front perspective view of the universal gondola base of the fixture.
Figure 1:
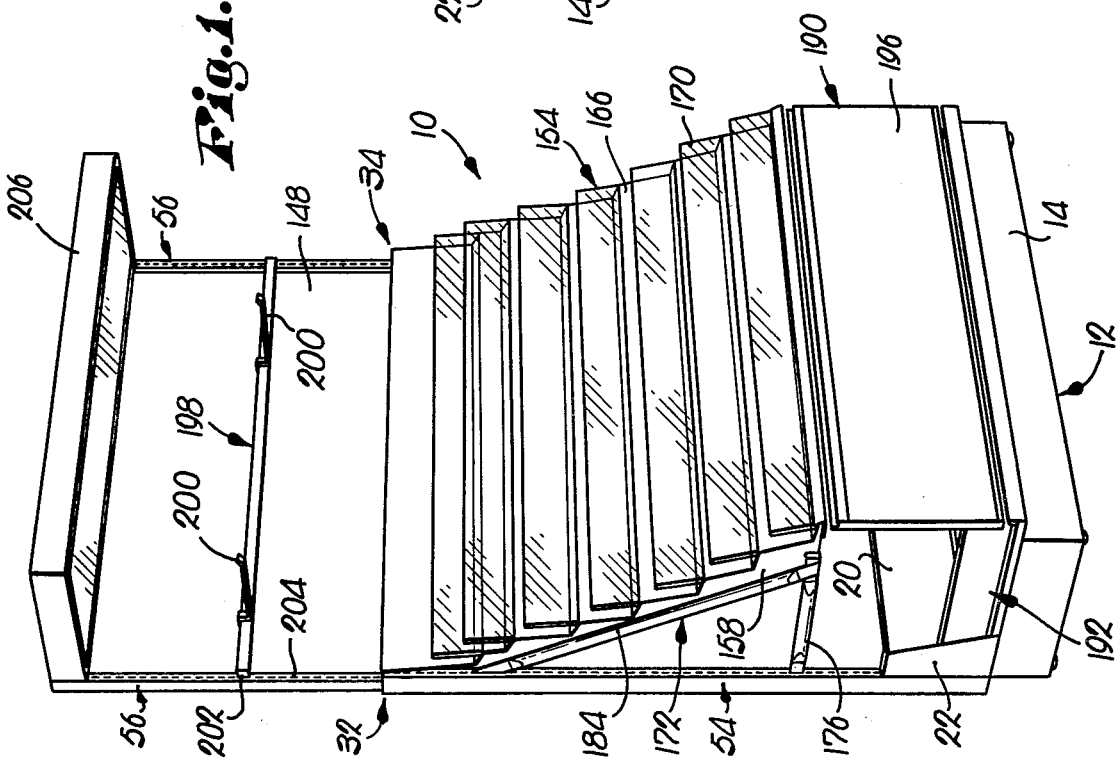

The fixture 10 illustrated in FIG. 1 is, by way of example, shown in a form that is particularly conducive for the display and merchandising of greetings cards and like articles. Typically, the fixture 10 will be set up in conjunction with and alongside of a series of other fixtures which may be similarly prepared for greeting card merchandising or for any number of other merchandisable items, such as paper products of various kinds of character, in which event, the fixture may be provided with inclined shelving racks, hooks or the like, none of which is shown herein but which may be readily used in connection with the basic components of the fixture 10 as will be described below. A gondola-type base 12 shown separately and apart from the rest of the components of the fixture in FIG. 2 forms the cornerstone of the fixture 10 and is common to all variations thereof except for dimensional differences. The base 12 is of unitary construction, broadly comprising an open, generally box-like, lowermost, floor-engaging portion 14, a flat, overlying panel 16 projecting beyond the forwardmost extremity of the base portion 14 to present an overhang 18, an upwardly projecting rear wall 20 rigidly affixed to the floor-engaging portion 14 and braced by generally triangular, corner gussets likewise rigidly affixed to the portion 14, and a series of height-adjustable feet 24 shown in FIG. 6 at the four corners of the floor-engaging portion 14 for leveling and height adjustment. The rear wall 20 has an upwardly facing and upturned lip 26 extending partially along the upper rear extremity thereof centrally of the latter (see also FIGS. 6 and 12) for a purpose which will hereinafter be made apparent.

Figure 4:
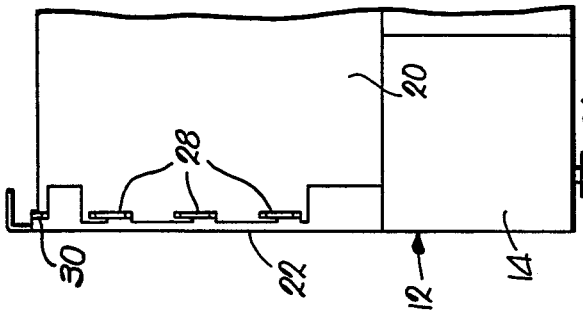
FIG. 4 is a fragmentary, rear elevational view of the left end of the base.
Figure 3:
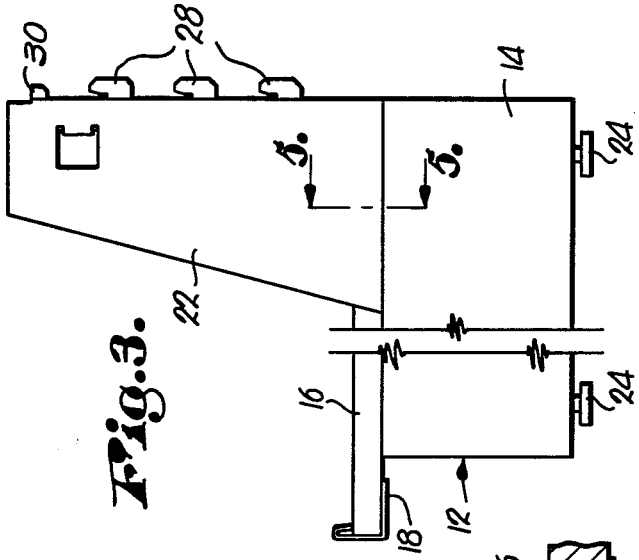
FIG. 3 is an enlarged, right end elevational view thereof.
Figure 5:
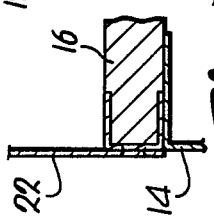
FIG. 5 is an enlarged, fragmentary cross-sectional view through the base taken substantially along line 5—5 of FIG. 3.

Each of the gussets 22, as perhaps best shown in FIGS. 3 and 4, has a vertical series of rearwardly projecting, upturned hooks 28 along the rearmost edge thereof above the floor-engaging portion 14 of the base 12. At a short distance above the uppermost hook 28 in the series, a rearwardly projecting tooth 30 is provided which is substantially devoid of the hooklike configuration found in the hooks 28. Referring now initially to FIG. 1, it may be seen that a pair of standards 32 and 34 are secured to the rear edges of the gussets 22 and supported thereby in upstanding fashion, the hooks 28 and the tooth 30 being received within appropriately positioned, corresponding slots 36 and 38 respectively in the standards 32 and 34. As illustrated best in FIG. 7, the hooks 28 project into and beyond the slots 36 and prevent further downward travel of the standards 32 and 34 after the same have been seated firmly in place upon the hooks 28, at which time a wall portion 40 of the standards 32,34 adjacent each slot 36 and above the latter slips between the upturned tip 28*a* of the corresponding hook 28 and the proximal rear edge of the gusset 22. When the lower edge extremity 42 of such wall portion 40 engages the top side of the normally horizontally extending leg 44 of the corresponding hook 28, the standard 32 or 34 assumes a firmly secured attachment to the base 12.

With the uprights 32,34 in their down-and-seated positions on the hooks 28, the teeth 30 at the rear edges of the gussets 22 project into and beyond their corresponding slots 38 in the standards 32,34 and, furthermore, project through a small hole 46 in a spring-locking tab 48 located interiorly of each standard 32,34 and pop-riveted at its upper end to the front wall portion 40 thereof. The small hole 46 corresponds closely in dimension to that of its tooth 30 so that, when the latter is indeed received within the hole 46, there can be no relative longitudinal displacement of the standards 32,34 relative to the gussets 22. Each spring tab 48 automatically yields and otherwise becomes properly disposed for receiving its corresponding tooth 30 during attachment of the standards 32,34 to the base 12, and once standards 32,34 are thusly secured in place, they cannot be removed without manual release of the spring tabs 48 by flexing the same yieldably outwardly away from the teeth 30 to disengage the latter from the small holes 46 and thereby permit lifting of the standards 32,34 off the hooks 28 in an upward, longitudinal direction. As noted particularly in FIG. 7, each locking tab 48 normally assumes a downwardly depending position yieldably biased into essentially covering relationship with the proximal slot 38 with the small hole 46 in aligned registration with slot 38 adjacent the upper region thereof. An upturned, finger-engageable lip 50 at the normally lower end of each tab 48 facilitates manipulation thereof.

Figures 6, 7, 8, 9, 10, 11, 19:
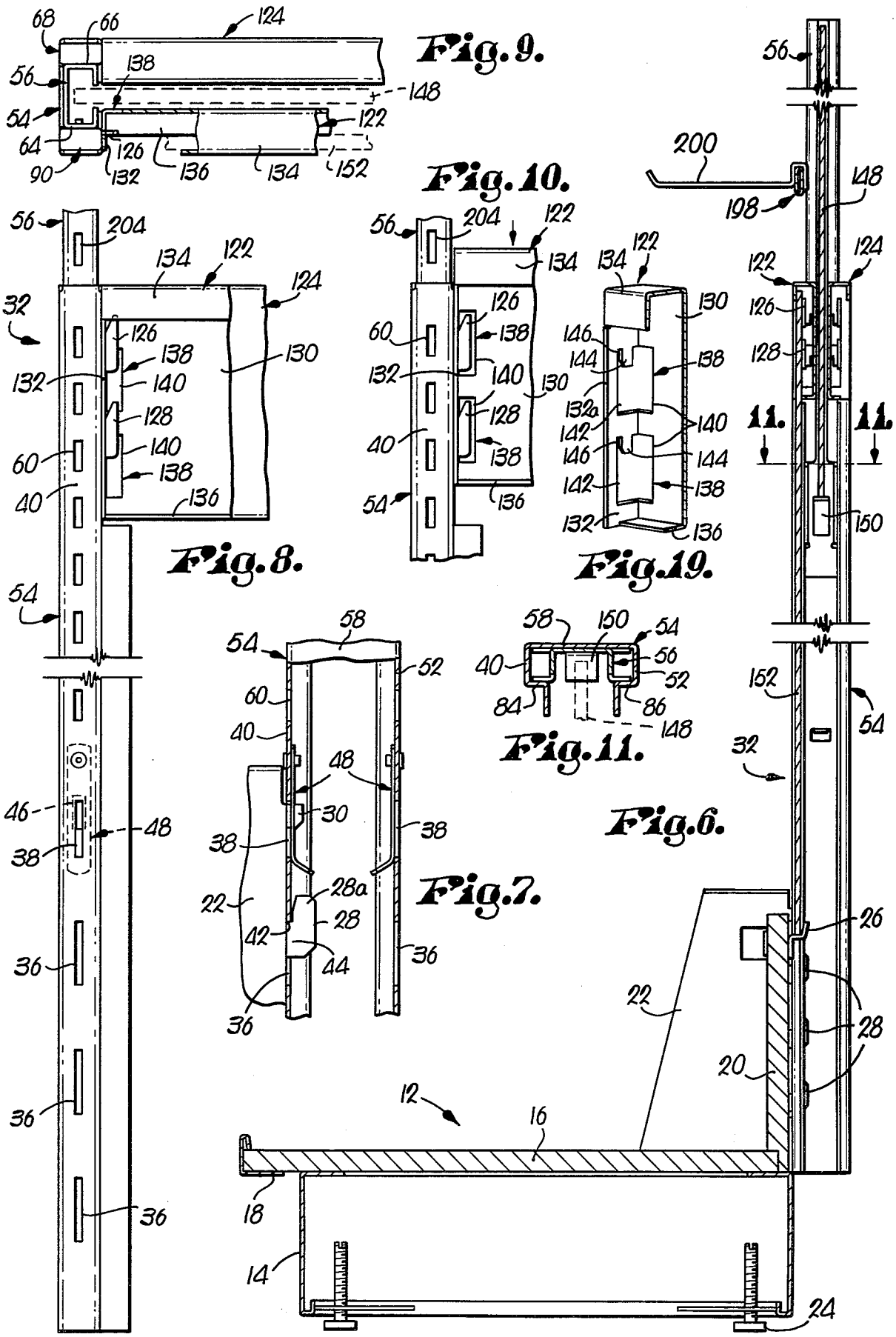
FIG. 6 is an enlarged, vertical cross-sectional view through the fundamental base and standard components of the fixture in a transverse direction showing details of construction.
FIG. 7 is an enlarged, fragmentary detail view thereof illustrating the way in which the standards are detachably secured at the lower ends to the rear side of the base.
FIG. 8 is a fragmentary, front elevational view of one of the standards and the proximal end of the transverse tie member releasably secured thereto.
FIG. 9 is a fragmentary, top plan view thereof with a pair of back-to-back tie members employed and parts being broken away to reveal details of construction.
FIG. 10 is a fragmentary, front elevational view of a partial left standard and corresponding end of the front tie member illustrating the manner in which the tie member is aligned with inwardly projecting hooks of the adjacent standard for front loading of the tie member from the aisle without spreading the opposite standards.
FIG. 11 is a fragmentary, transverse, horizontal cross-sectional view through one of the standards taken substantially along line 11—11 of FIG. 6.
FIG. 19 is a right front, fragmentary perspective view of the left end of the transverse tie member detailed in FIG. 8, 9 and 10 illustrating in particular the special intersecting, hook-receiving openings of the tie member that permit front loading thereof into spanning relationship with the uprights.

The two standards 32 and 34 are identical in construction and operation. Their symmetrical design as will hereinafter be explained in more detail, permits one to be substituted for the other during initial installation and, in this respect, FIG. 7 illustrates that a second locking tab 48*a* identical in construction and function to the first locking tab 48, is provided along a normally rear wall 52 of each standard 32,34 for use when a second fixture (not shown) is set up in back-to-back relationship with the fixture 10. The wall 52 likewise being provided with a series of slots 36 and 38 so that the standard 32 may be replaced by the standard 34 and vice versa, thereby facilitating installation, disassembly and reassembly.

Each of the standards 32,34 is telescopically extensible in nature, having a lower, outer section 54 of generally transversely C-shaped configuration, and an upper, inner section 56 likewise of generally transversely C-shaped configuration telescopically received within the outer section 54. The walls 40 and 52 within which the notches 36 and 38 are provided are essentially opposite edge walls of the outer section 54, said edge walls 40 and 52 being spanned along one side by a web 58 running the full length of the outer section 54. Additional slots 60 in the edge walls 40,52 provide a means of attachment for various other alternative components of the fixture 10 as will subsequently appear.

At the point of emergence of the inner section 56 from the outer section 54 at the upper end of the latter, each of the standards 32,34 is provided with quick-release latch means broadly denoted by the numeral 62 and illustrated in particular detail in FIGS. 15–18. As noted, although the inner section 56 is slidably and shiftably received within the outer section 54, the latter receives the inner section 56 in substantially spaced relationship thereto along the opposite, normally fore-and-aft sidewalls 64 and 66 thereof. It is within this available space that the components of the latch means 62 are located and retained.

Specifically, it will be noted that one component 68 of the latch means 62 has the function essentially of a spacer and bearing member for the reciprocable inner section 56. To this end, the molded component 68 of synthetic resinous material is wedged down into the available space between the wall 52 of outer section 54 and sidewall 66 of inner section 56. Spacer component 68 is largely rectangular when viewed in side elevation from any selected one of the four facing sides thereof, is provided with an upwardly extending, through slit 70 that divides the body thereof into a pair of depending furcations 72 and 74 having rounded lowermost extremities 76 and 78 respectively; with an integral cap 80 overhanging the legs 72,74 along two sides thereof; and with an integral locking nib 82 projecting outwardly from an outer face of the leg 78 and configured in the nature of a barb for facilitating initial wedging entry of the component 68 into position but preventing accidental withdrawal thereof during extension of the inner section 56. In this regard, it will be noted that the outer section 54 includes a pair of inturned stretches 84 and 86 along the full length of the edge walls 40 and 52. The inturned stretch 86 is provided with a limit notch 88 therein adjacent the upper end of the outer section 54 in disposition to receive the barb-like locking nib 82 of component 68 and allow the latter to project through and beyond the plane of the stretch 86. The upper edge extremity of the limit notch 88 thereby serves to engage the top side of the locking nib 82 and prevent accidental withdrawal of the component 68 upon extension of the inner section 56. On the other hand, the overhanging cap 80 of component 68 bears against the uppermost edge extremity of the inturned stretch 84 and the web 58 to limit the extent of inward movement of the component 68 with respect to the outer section 54.

The latch means 62 further includes as its component of primary importance a one-way locking pawl 90 constructed of a molded, synthetic resinous material and having a configuration somewhat similar to that of the component 68 yet different in certain important respects. The pawl 90 is adapted to be wedged into the space between the sidewall 64 of the inner section 56 and the edge wall 40 of the outer section 54 and is generally rectangular when viewed in side elevation. A through slit 92 leads upwardly from the bottom extremity of the pawl 90 to a point slightly beyond the midsection thereof to divide the lower body portion of the pawl 90 into a pair of depending legs 94 and 96 having rounded front corners 98 and 100 respectively at the intersection of the front, inner-section-engaging face 102 and the bottom surface 104 (FIG. 16). Face 102 is flat and is provided with an outwardly extending projection 106 having an upper, load-bearing edge 108 normal to the plane of the face 102 and a lower cam edge 110 sloping outwardly and upwardly from the face 102.

The opposite, rear face 112 of the pawl 90 includes a relief notch 114 across the width thereof of such configuration as to permit the pawl 90 to rock rearwardly away from the inner section 56 when the upper edge extremity of the outer section 54 is received within the notch 114 as illustrated in FIG. 16. A cap 116 across the upper extremity of the pawl 90 overhangs the opposite sides of the latter extending between the faces 102,112, in disposition for abutting engagement with upper edge extremities of the inturned stretch 84 and the web 58 to limit the extent of inward movement of the pawl 90. Additionally, a projecting nib 118 adjacent the lower end of one side of the pawl 90 extends into a limit notch 120 in the inturned stretch 84 to abuttingly engage the upper extremity thereof when the pawl 90 is partially withdrawn from the outer section 54 as illustrated in FIG. 16 to limit such outward movement of the pawl 90 to the FIG. 16 position. Nib 118 is also of assistance in limiting inward movement of the pawl 90 upon engagement with the lower extremity of the limit notch 120 when the pawl 90 is in its FIG. 15 position.

In order to stabilize and rigidify the standards 32,34, they are provided with a pair of back-to-back, structural tie members 122 and 124 which span the standards 32,34 at the upper end of the outer sections 54 thereof (FIGS. 6, 8, 9, 10, 19). The standards 32,34 are so oriented that the broad, flat webs 58 of the lower standard sections 54 face outwardly, away from one another while the inner, channel-like open side of the outer standard sections 54 face toward one another. Each outer section 54 adjacent its upper end is provided with two upper and lower pairs of hooks 126 and 128 respectively projecting outwardly from the inturned stretches 84 and 86, each of the stretches 84,86 having an upper hook 126 and a lower hook 128. As a result of the described orientation of the standards 32,34, the hooks 126,128 of standard 32 project generally toward the opposite hooks 126,128 of the standard 34.

Each of the tie members 122,124 is provided with a broad, flat back panel 130 along the full length thereof and with a pair of inturned flanges 132 at opposite ends of the back panel 130 (only one of the flanges 132 being illustrated). A formed, downwardly opening channel 134 is provided along the top of each tie member 122,124 disposed along the inward side of the back panel 130, the channel 134 extending inwardly to the edge extremity **132*a* of the flanges 132. An inturned bottom lip 136 along the lower edge extremity of each back wall 130 is slightly set back with respect to the edge extremity 132*a* of flanges 132**.

Each tie member 122,124 is provided with aperture means broadly denoted by the numeral 138 at the opposite ends thereof for releasably securing the tie members 122,124 in place on the hooks 126,128. An aperture means 138 is provided for each of the hooks 126,128 and includes a pair of openings 140 and 142 (FIG. 19) in the back panel 130 and the proximal flange 132 respectively. Openings 140 and 142 are interconnected and in open communication with one another. As a result of the right angle intersection between the back panel 130 and each flange 132, the openings 140 and 142 are likewise disposed at right angles to one another.

Each opening 140 is sized to permit passage therethrough of the corresponding hook 126 or 128 when the latter is aligned with the opening 140 in the manner illustrated in FIG. 10. Thus, the hooks 126,128 may pass through the openings 140 and immediately into the openings 142 when the tie member 122 or 124 is registered with the hooks 126,128 as shown in FIG. 10 and displaced horizontally in the appropriate forward or rearward direction. With the hooks 126,128 thus aligned with the openings 140,142, hooks 126,128 will clear depending tangs 144 of the openings 142, but when the tie member 122 or 124 is thereafter forced downwardly, slits 146 in the flanges 132 adjacent the tangs 144 accept and retain the upwardly facing hooks 126,128 as the tie members 122,124 are seated. Tangs 144 prevent horizontal, fore-and-aft displacement under such conditions, and the hooks 126,128 prevent horizontal lateral displacement.

It will be noted from FIGS. 6, 9 and 12 that the back-to-back tie members 122,124 are actually spaced apart in a fore-and-aft direction so that clearance is provided between the two back panels 130 thereof. This space may serve as a guideway and confining area for a decorative or functional, upstanding sheet of fiberboard 148 or other material. The sheet 148 may be provided with attractive vinyl coverings on either or both of its opposite sides if the sheet 148 is to provide no particular article-or-product-supporting-and-displaying function; on the other hand, the sheet 148 may be in the nature of pegboard providing a multitude of holes (not shown) by which a variety of supporting hangers, baskets and hooks may be attached for product display purposes.

The sheet 148 spans the standard 32,34 and projects into the corresponding inner sections 56 thereof as illustrated in FIG. 9. Furthermore, it is supported along its bottom edge by inturned ledges 150 projecting inwardly from opposite ones of the inner sections 56 of standards 32,34. In this manner, the sheet 148 is automatically raised and lowered with the inner sections 56 when the standards 32 and 34 are extended and retracted, thereby providing an unbroken continuity of flat surface area in the upper regions of the fixture regardless of the selected height of the standards 32,34.

As illustrated in FIG. 6, the fixture 10 may also be provided with a second decorative or functional sheet 152 covering the lower otherwise open area between the standards 32,34. The sheet 152 would normally not be necessary in installations where the fixture 10 is equipped with a greeting card display deck as hereinafter described, since such deck would cover the sheet 152 and render its aesthetics or functionality superfluous. In those situations where shelving, baskets and other hanger-type brackets are utilized, however, the use of sheet 152 is preferred. As in the case of sheet 148, the sheet 152 may be merely decorative, in which case it may be provided with a vinyl covering, or it may likewise be in the nature of a pegboard having a multitude of functional openings therein designed to cooperate with supporting hooks and brackets. In either event, it is noteworthy that the sheet 152 extends the full width of the space between standards 32 and 34, is supported at its lower end by the upturned lip 26 on the back side of the rear wall 20, and is trapped at its upper end by the channel 134 of front tie member 122 on the one hand and the outer edge of lip 136 of that member 122 on the other hand as shown in FIGS. 6 and 9.

As earlier stated, and as shown particularly in FIGS. 1, 12, 13 and 14, the fixture 10 may be equipped with a greeting card display deck broadly denoted by the numeral 154. The deck 154 comprises a generally rectangular, open-box frame 156 having a pair of upwardly and rearwardly inclined side pieces 158, a lower cross piece 160 rigidly secured at its opposite ends to the side pieces 158, and an upper cross piece 162 rigidly secured at its opposite ends to the side pieces 158. The side pieces 158 are each provided with a sawtooth-like series of steps 164 along their upper inclined edge, and the steps 164 matingly receive the corrugations of a vacuum formed, synthetic resinous, corrugated overlay panel 166 suitably attached to the side pieces 158, the lower cross piece 160 and the upper cross piece 162 such as by adhesive bonding. The echelon or cascading-type, stair-stepped quality thus imparted to the exposed forward face of the display deck 154 thereby partially contributes to the formation of a series of card display compartments 168 which may be further subdivided and defined by transverse partitions (not shown) and generally L-shaped, transparent, synthetic resinous retainers 170 secured to the defined steps of the deck 154.

The deck 154 is held in place within the confines of the fixture 10 by sling brackets 172 and 174 that suspend or hang the deck 154 from the standards 32,34 in overhanging relationship to the universal base 12. Each of the brackets 172,174 includes a horizontal, forwardly extending leg 176 having a downturned hook 178 at its inner end adapted to be releasably received within and retained by a selected slot 60 of the outer section 54 of the corresponding standard 32 or 34. The outer end of each leg 176 has an inturned curl 180 which slips edgewise up into a downwardly facing notch 182 in the corresponding side piece 158 of frame 156. The lower legs 176 are thereby releasably and removably received within the notches 182 to support the lower end of the deck 154 outwardly from the standards 32,34 in such a way that the lowermost and outermost forward extremity of the deck 154 is generally vertically aligned with the front extremity of the base 12. On the other hand, the upper, rear extremity of the deck 154 simply leans back against the standards 32,34; more specifically, the upper cross piece 162 abuttingly engages and rests against the forward exterior of the channel 134 of front tie member 122.

In order to brace the legs 176 of the sling brackets 172,174, each of the latter also includes an upwardly and rearwardly extending diagonal bracing leg 184 welded or otherwise fixedly secured at its lower, forward end to the horizontal leg 176 at a point set back slightly from the curl 180. The opposite, upper rear end of each diagonal leg 184 carries suitable hooks 186 and 188 for insertion into and releasable retension by an appropriate one of the upper slots 60 in the outer sections 54 of standards 32,34. Preferably, the sling brackets 172,174 are constructed from tubular bar stock and are flattened at appropriate locations to facilitate fixed interconnection of the legs 176,184 and formation of the hooks 178, 186, 188 and the curls 180. In the alternative, the sling brackets 172,174 may be constructed from suitable wire rod stock appropriately configured, formed and provided with attaching hook structure.

As shown in somewhat detail in FIGS. 1 and 12, the fixture 10 may also be provided with a pullout storage drawer 190 for the safe, secure and convenient storage of an inventory of products available to replenish the depleted supply of products displayed on the fixture 10. The drawer 190 is provided with suitable glide mechanism 192 attaching the same to the base 12 and is basically of opensided construction, having only a floor 194 and an upstanding front wall 196 covered with a decorative vinyl or the like. It is to be noted that neither the drawer 190 or any of its associated structure attaching the same to the base 12 serves as a means of supporting the overhanging card display deck 154.

The fixture 10 may, if desired, also be provided with a special hanger-support bar 198 illustrated in FIGS. 1 and 6 spanning the standards 32,34 above the card display deck 154 for te purpose of displaying such items as bows, ribbons, wrapping paper packets and other miscellaneous items which may advantageously be suspended in rank from hangers 200 attached to the bar 198 and extending laterally outwardly therefrom toward the front of the fixture. As illustrated in FIG. 6, the bar 198 is constructed from a flattened tube in order to provide structural rigidity, to resist torsional stresses induced by the weight of items suspended from the hangers 200 outboard of the bar 198, and to facilitate the insertion of releasably held clip hooks 202 into opposite ends of the bar 198. The hooks 202 are compatible with the slots 204 along the proximal surface of the inner standard sections 56 for releasably and detachably holding the bar 198 at a selected height position.

Additionally, the fixture 10 may be provided with an overhead lighting unit 206 for illuminating the display, the unit 206 being releasably and detachably secured to the standards 32,34 utilizing hooks (not shown) along the rear extremity thereof compatible with the slots 204 of the inner standard section 56. In the alternative, other suitable capping structures or the like may be utilized in lieu of the lighting unit 206 as may be necessary or desirable for the particular installation at hand.

OPERATION

Operation and use of the fixture 10 should be readily apparent from the foregoing description. Accordingly, only limited reference will now be made to that aspect of the invention.

With the base 12, the standards 32,34 and the tie members 122,124 as the basic components of the fixture 10 utilized in all versions thereof, whether for aisle units, end of aisle or wall display and whether for greeting cards requiring display decks of the type exemplified by deck 154 or inclined shelving and wire baskets and hangers for other items of merchandise, it is apparent that the fixture 10 of the present invention exhibits an unusual degree of flexibility without sacrificing structural integrity or aesthetic appeal. Although the standards 32,34 are supported by the base 12 only through cantilever attachment via hooks 28, teeth 30, slots 36,38 and locking tabs 48, it will be appreciated that such support is more than ample under the circumstances, particularly considering the presence of the gussets 22 and their fixedly rigid interconnection with the remainder of the base 12. Thus, the standards 32,34 are fully capable of accommodating the loading provided by any of the various forms of shelvings, brackets and card display decks that might be desired.

Setup of the fixture 10 as illustrated in FIG. 1 is a relatively simple and expeditous procedure which can be carried out with a substantial avoidance of tools and nut-and-bolt type fasteners. First, the standards 32,34 are installed, it being simply necessary to so orient the same that their open channel portions are facing one another and the slots 36 are aligned with the hooks 44 on the rear of the base 12. The teeth 30 adjacent the hooks 44 will deflect the spring tabs 48 at this time and not interfere with installation upon the hooks 44, but as the standards 32,34 are then seated downwardly onto the hooks 28, the small holes 46 of the spring-locking tabs 48 will be brought into registration with the teeth 30 and will snap over the same and securely lock the standards 32,34 in place. If, for any reason, it is desired to remove either or both of the standards 32,34, it is but necessary to manually deflect the spring tabs 48 away from the teeth 30 using the upturned lips 50 thereof, whereupon the standards 32,34 can be simply lifted off the hooks 28.

Next, the transverse tie members 122,124 are installed. This is quite easily accomplished by simply aligning the first of the members, such as the member 122, with its hooks 126,128 as illustrated in FIG. 10 until the openings 140 are registered with the hooks 126, 128, then shifting the member 122 rearwardly until the hooks 126, 128 enter the openings 142, and thereupon seating the member 122 upon the hooks 126,128 as the latter enter the slits 146. The rear tie member 124 is installed in an identical manner from the backside of the fixture 10.

The front sheet 152 as illustrated in FIG. 6 may be added, if desired. With the tie member 122 in the raised position of FIG. 10, the lower end of the sheet 152 is slipped down onto lip 26 and the upper end of the sheet 152 is then swung inwardly into registration with the overhanging channel 134 of the raised, front tie member 122. The member 122 is then pushed down onto the teeth 126 and 128 until seated, trapping the sheet 152 in channel 134. The use of the sheet 152 is, however, optional considering that the deck 154 will cover the same.

The two standards 32,34 are then prepared for height selection by installation of the two sets of latch means 62. When the locking pawl 90 of a latch has been slipped down into position between the inner section 56 and the outer section 54, the corresponding spacer-bearing component 68 may then be forced down into place on the opposite side of the standard 32 or 34. Once installed as shown in FIG. 15, each inner section 56 is securely held in place by its locking pawl 90 as the projection 106 thereof is received by a proximal slot 204 of the inner section 56. No further retraction of the standard 32,34 is permitted in view of the fact that the inner section 56 is interlocked with the pawl 90 via the projection 106 and the pawl 90 is, in turn, retained against movement further into the outer section 54 by engagement of the cap 116 with the upper end extremity of the outer section 54 and engagement of the nib 118 with the lower edge extremity of the limit slot 120.

Extension of the standards 32,34 is immediately and easily available, however. In this regard, simply lifting on the innner section 56 will result in an immediate outward movement of the inner section 56 as the pawl 90 travels with the same to the extent permitted by the limit nib 118 engaging the upper extremity of the limit notch 120. At that instant, the continued movement of inner section 56 causes the pawl 90 to be rocked rearwardly away from the inner section 56 to its FIG. 16 position, encouraged in this rocking movement by the cam action induced from engagement of the lower edge extremity of the particularly slot 204 entered by the projection 106 as it bears against the cam edge 110 thereof. The pawl 90 is completely released at this time for unhindered extension of the inner section 56.

When a selected height for the standard 32,34 has been reached, a light thumb pressure against the outboard side of the pawl 90 to press the projectoin 106 against the inner section 56 is all that is necessary to dispose the projection 106 for immediate reentry into the next-above slot 204 as the inner section 56 is settled slightly. Thereupon, with the projection 106 entered in the selected slot 204, the inner section is pressed downwardly for a short distance to firmly wedge the pawl 90 back into position fully within the outer section 54 as illustrated in FIG. 15, whereupon the standard 32,34 is once again fully locked against further retraction.

The upper sheet panel 148 may be slipped into place from the top between the standards 32,34 until coming to rest upon the ledges 150. If need be, of course, the standards 32,34 may be height adjusted even with the sheet 148 installed in view of the fact that the latter will quite readily slip between but be retained by the back-to-back tie bar members 122,124. Inasmuch as the ledges 150 are rigidly secured to and made a part of the inner section 56, extending and retracting the latter likewise raises and lowers the sheet 148.

The hanger bar 198 is simply hooked in place as is also either the lighting unit 206 or the selected capping structure. The deck 154 is readily installed by first simply hanging the sling brackets 174 from the standards 32,34 at the selected height. Thereupon, the deck 154 is held upright with its notches 182 receiving the curls 180 of sling brackets 174. Once the curls 180 are fully received within the notches 182, the deck 154 may simply be pivoted about that loose interconnection and swung to the rear as the top piece 162 comes to bear against the front transverse tie bar member 122.

The drawer 190 or other suitable storage structure may be installed either before or after the hanging of the card deck 154 as may be convenient, necessary or desirable under the circumstances. Disassembly and conversion of the fixture 10 into a unit more compatible with other types of products to be displayed is as simply and quickly accomplished as the installation thereof above described.

We claim:

1. A product display fixture comprising:

a floor-engaging base having front and rear sides;

a pair of upright support standards projecting upwardly from the rear side of said base;

up upwardly and rearwardly inclined product display deck having a stair-stepped series of product-receiving-and-displaying compartments; and means suspending said deck from said standards in full supported relationship thereby and located forwardly of the standards in overhanging relationship from said base with the lower front extremity of said deck generally aligned with but not supported by said front side of the base and the upper rear extremity of the deck leaning against an upper portion of said standards generally aligned with the rear side of said base.

said suspending means including a pair of rigid sling members on opposite sides of said deck provided with inner ends attached to corresponding ones of said standards and with outer ends coupled with the deck adjacent said lower front extremity thereof, each of said sling members including a generally horizontally outwardly extending lower leg and an upwardly and rearwardly extending diagonal leg rigidly secured to said lower leg adjacent said outer end of the member.

2. A product display fixture as claimed in claim 1, wherein said suspending means and said standards are provided with releasably interengageable hook-and-slot connectors adapted to permit positioning of the deck at any selected one of a number of vertical dispositions.

3. A product display fixture as claimed in claim 1, wherein the inner ends of the legs of the sling members and said standards are provided with releasably interengageable hook-and-slot connectors adapted to permit positioning of the sling members at any one of a number of available locations along the standards.

4. A product display fixture as claimed in claim 1, wherein each of said sling members is provided with an inturned hook adjacent the outer end thereof, said deck having a pair of notches adjacent said lower front extremity thereof receiving corresponding ones of said hooks to effect said coupling of the deck to the sling members.

5. A product display fixture as claimed in claim 3, wherein said deck includes an open, generally rectangular frame having a pair of opposite, diagonal side pieces, a lower transverse piece interconnecting said side pieces at the lower front ends thereof, and an upper transverse piece interconnecting said side pieces at the upper ends thereof, said side pieces having a series of stair-stepped, upwardly facing ledges therein and said deck further including a panel overlying said frame, spanning said side pieces and corrugated in a manner to be matingly received at its opposite ends by the underlying ledges of said side pieces whereby to partially define said product-receiving-and-displaying compartments of the deck.

6. A product display fixture as claimed in claim 1, wherein said deck includes an open, generally rectangular frame having a pair of opposite, diagonal side pieces, a lower transverse piece interconnecting said side pieces at the lower front ends thereof, and an upper transverse piece interconnecting said side pieces at the upper ends thereof, said side pieces having a series of stair-stepped, upwardly facing ledges therein and said deck further including a panel overlying said frame, spanning said side pieces and corrugated in a manner to be matingly received at its opposite ends by the underlying ledges of said side pieces whereby to partially define said product-receiving-and-displaying compartments of the deck.

7. A product display fixture as claimed in claim 1; and a drawer carried by said base below said deck without engagement with or support for the deck.

8. A product display fixture as claimed in claim 1, wherein said base and said standards are provided with releasably interlocking structure adapted to detachably secure the lower ends of said standards to said rear side of the base, said interlocking structure including a vertical series of slots in the standards, one or more upwardly turned hooks on the base for insertion into corresponding slots of the standards, a pair of locking projections on the base projecting into corresponding slots of the standards, and a pair of manually releasable, inherently resilient springlocking tabs on respective ones of said standards provided with respective receiving apertures for said projections and yieldably biased into normal locking positions receiving said projections into said apertures.

9. A product display fixture as claimed in claim 1, wherein each of said uprights is extensible for adjusting the same to any one of a number of upright lengths and is provided with means for releasably locking the same in a selected, adjusted length.

* * * * *

UNITED STATES PATENT AND TRADEMARK OFFICE

CERTIFICATE OF CORRECTION

PATENT NO. : 4,460,097

DATED : July 17, 1984

INVENTOR(S) : James P. Darnell, II and Jon D. Bridgwater

It is certified that error appears in the above-identified patent and that said Letters Patent is hereby corrected as shown below:

Column 12, line 37, delete the word "up" and substitute therefore --an--.

Signed and Sealed this

*Sixteenth* Day of *April 1985*

[SEAL]

*Attest:*

DONALD J. QUIGG

*Attesting Officer* *Acting Commissioner of Patents and Trademarks*